US012642355B2

(12) United States Patent
Jiang et al.

(10) Patent No.: US 12,642,355 B2
(45) Date of Patent: Jun. 2, 2026

(54) POWERED CHAIR WITH INDEPENDENT SEAT

(71) Applicant: MOTOMOTION CHINA CORPORATION, Changzhou (CN)

(72) Inventors: Hai Guo Jiang, Changzhou (CN); Wu Qing Pan, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 101 days.

(21) Appl. No.: 18/731,251

(22) Filed: Jun. 1, 2024

(65) Prior Publication Data

US 2025/0248521 A1 Aug. 7, 2025

(30) Foreign Application Priority Data

Feb. 4, 2024 (CN) ..... 202420275905.9

(51) Int. Cl.

| | |
|---|---|
| ***A47C 1/034*** | (2006.01) |
| ***A47C 1/035*** | (2006.01) |
| ***A47C 1/0355*** | (2013.01) |
| ***A47C 7/54*** | (2006.01) |

(52) U.S. Cl.

CPC ..... *A47C 1/0345* (2013.01); *A47C 1/034* (2013.01); *A47C 1/035* (2013.01); *A47C 1/0355* (2013.01); *A47C 7/54* (2013.01)

(58) Field of Classification Search

CPC ..... A47C 1/0342; A47C 1/035; A47C 1/0355

See application file for complete search history.

(56) References Cited

U.S. PATENT DOCUMENTS

| | | | | |
|---|---|---|---|---|
| 2005/0052067 | A1* | 3/2005 | Grimm | A47C 17/134 297/423.2 |
| 2021/0337969 | A1* | 11/2021 | Sidorov | A47C 1/035 |
| 2024/0108136 | A1* | 4/2024 | Crum | A47C 1/0355 |
| 2024/0122346 | A1* | 4/2024 | Murphy | A47C 1/0355 |
| 2024/0138569 | A1* | 5/2024 | Murphy | A47C 3/0255 |
| 2025/0248521 | A1* | 8/2025 | Jiang | A47C 1/0345 |

* cited by examiner

*Primary Examiner* — Rodney B White

(74) *Attorney, Agent, or Firm* — Law Ofices of StevenW. Weinrieb

(57) ABSTRACT

A powered chair comprises a chair framework, which includes a pair of oppositely disposed armrests, a chair seat frame which is fixedly connected to the pair of armrests, a footrest, a backrest, a first linear actuator mounted upon the pair of armrests and operatively connected to the footrest, and a second linear actuator mounted upon the armrests and operatively connected to the backrest. When the first and second linear actuators are actuated, they can respectfully actuate or move the footrest and backrest, however, in view of the fact that the first and second linear actuators are not operatively connected to the chair seat frame, and in view of the additional fact that the chair seat frame is fixedly mounted upon the pair of armrests, the chair seat frame will remain stationary despite movements of the footrest and backrest, to any one of their multiple positions, as a result of the actuation of the first and second linear actuators.

17 Claims, 8 Drawing Sheets

POWERED CHAIR WITH INDEPENDENT SEAT

FIELD OF THE INVENTION

The present invention relates generally to powered chairs, and more particularly to a new and improved powered chair for powering and moving the backrest and footrest components of the chair independently of the seat member of the chair, or in other words, when the backrest and footrest components of the chair are moved between various predetermined positions, the seat member of the chair remains fixed.

BACKGROUND OF THE INVENTION

Powered chairs are often utilized within homes or offices, and usually comprise one or more powered actuators operatively connected to the various different components of the chair, such as, for example, the backrest, the chair seat frame, the footrest, and the like, so as to move such components to various different positions whereby the chair can attain various different states or dispositions, such as, for example, a seated position, a TV position, a reclined position, a zero-gravity position, a lift position, or the like. Accordingly, when the one or more powered actuators move the backrest, footrest, and other components of the chair, the chair seat frame will likewise be moved, however, this may not be particularly desired by the occupant of the chair because it may render sitting in the chair seat frame uncomfortable.

A need therefore exists in the art for a new and improved powered chair. Another need exists in the art for a new and improved powered chair whereby the various components of the chair, such as, for example, the footrest and backrest, can be moved to different positions such that the powered chair can achieve different states or dispositions. Still another need exists in the art for a new and improved powered chair whereby the various components of the chair, such as, for example, the footrest and backrest, can be moved to different positions such that the powered chair can achieve different states or dispositions, such as, for example, a seated position, a TV position, and a reclined position. Yet another need exists in the art for a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame.

Still yet another need exists in the art for a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame such that despite the movements of the footrest and backrest to any one of their various powered positions, the chair seat frame remains disposed at its originally fixed position with respect to the chair framework. Yet still another need exists in the art for a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame such that despite the movements of the footrest and backrest to any one of their various powered positions, the chair seat frame remains disposed at its originally fixed position with respect to the chair framework such that the comfort of the chair user or occupant is not compromised.

OVERALL OBJECTIVES OF THE INVENTION

Accordingly, an overall objective of the present invention is to provide a new and improved powered chair. Another overall objective of the present invention is to provide a new and improved powered chair whereby the various components of the chair, such as, for example, the footrest and backrest, can be moved to different positions such that the powered chair can achieve different states or dispositions. Still another overall objective of the present invention is to provide a new and improved powered chair whereby the various components of the chair, such as, for example, the footrest and backrest, can be moved to different positions such that the powered chair can achieve different states or dispositions, such as, for example, a seated position, a TV position, and a reclined position. Yet another overall objective of the present invention is to provide a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame.

Still yet another overall objective of the present invention is to provide a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame such that despite the movements of the footrest and backrest to any one of their various powered positions, the chair seat frame remains disposed at its originally fixed position with respect to the chair framework. Yet still another overall objective of the present invention is to provide a new and improved powered chair whereby the various components of the chair, such as, for example, the footrest and backrest, can be moved to different positions such that the powered chair can achieve different states or dispositions, such as, for example, a seated position, a TV position, and a reclined position, however, such movements of the footrest and backrest are independent of the chair seat frame such that despite the movements of the footrest and backrest to any one of their various powered positions, the chair seat frame remains disposed at its originally fixed position with respect to the chair framework such that the comfort of the chair user or occupant is not compromised.

SUMMARY OF THE INVENTION

The foregoing and other objectives are achieved in accordance with the principles and teachings of the present invention through the provision of a new and improved powered chair which comprises a chair framework, which includes a pair of oppositely disposed left and right armrests, a chair seat frame which is fixedly connected to the pair of oppositely disposed, left and right armrests, a footrest, a backrest, a first linear actuator having opposite ends thereof connected to the pair of oppositely disposed, left and right armrests and to the footrest, and a second linear actuator having opposite ends thereof connected to the pair of oppositely disposed, left and right armrests and to the backrest. In this manner, when the first and second linear actuators are actuated, they can respectfully actuate or move the footrest and backrest, however, in view of the fact that the first and second linear actuators are not operatively connected to the chair seat frame, and in view of the additional fact that the chair seat frame is fixedly mounted upon the pair of oppositely disposed, left and right armrests, the chair seat frame will remain stationary despite movements of the footrest and backrest, to any one of their multiple positions, as a result of the actuation of the first and second linear actuators. The foregoing structural connections are achieved through means of a plurality of cross-bar members, upon which the first and second linear actuators are mounted, and a plurality of linkage members operatively connecting the first and second linear actuators to the footrest and backrest components.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein.

Figure 1:
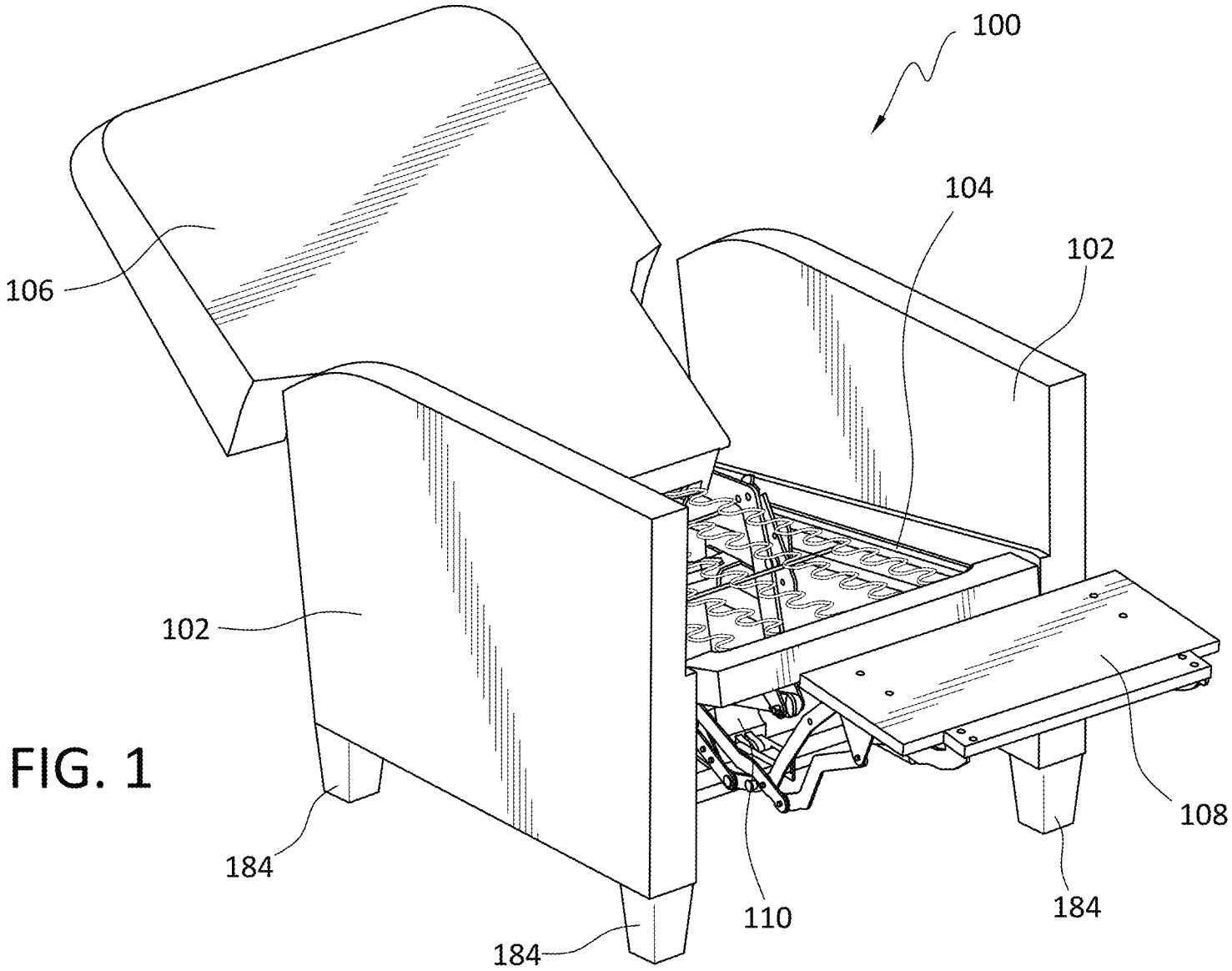
FIG. 1 is a left side, top perspective view of the new and improved powered chair as constructed in accordance with the principles and teachings of the present invention, and showing the powered chair when the footrest and backrest components have been moved to their extended and reclined positions.
Figure 6:
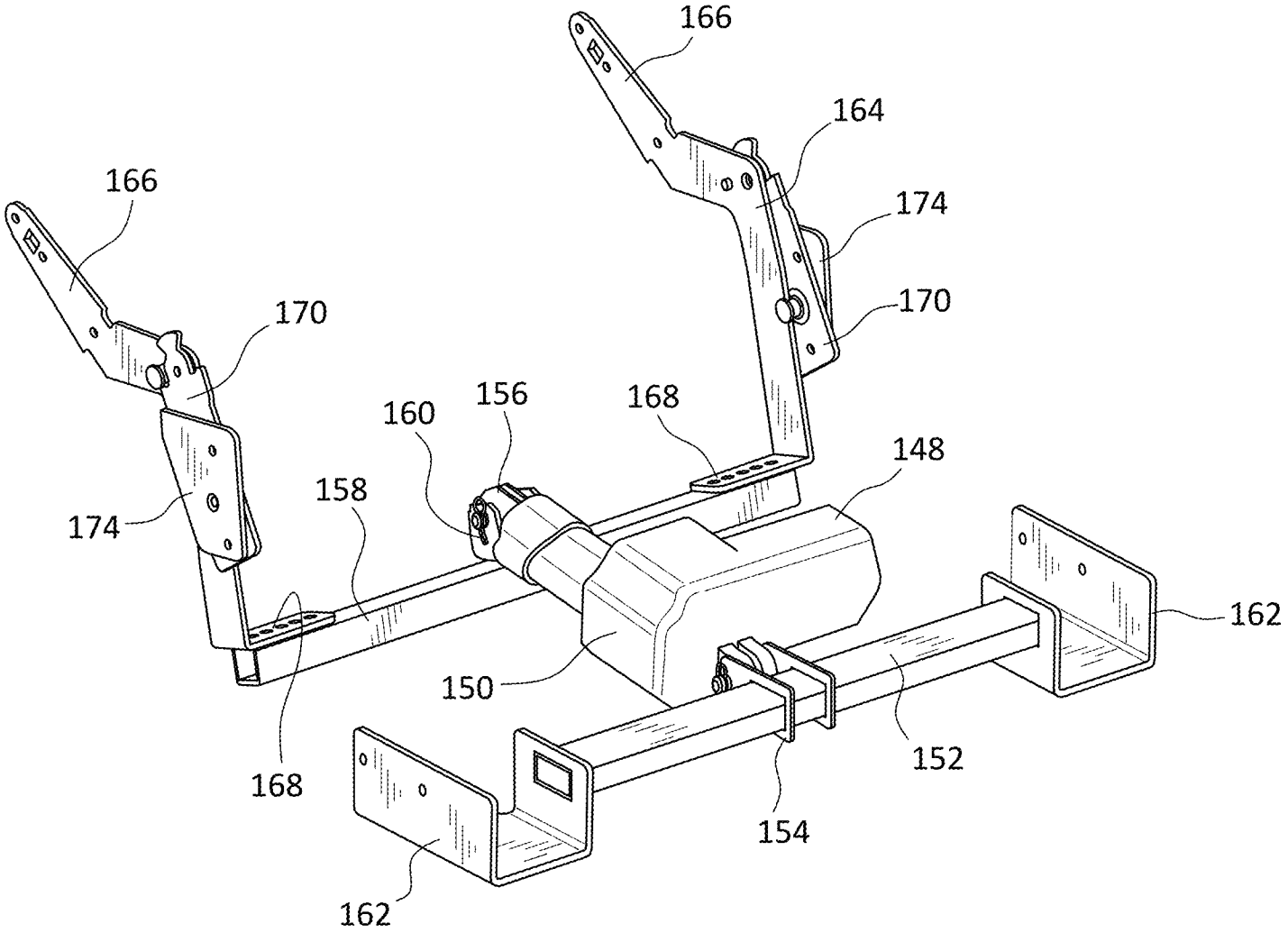
FIG. 6 is a schematic detailed view showing how the second linear actuator is operatively connected to the backrest component of the powered chair by means of a plurality of linkage members and cross-bar members.
Figure 7:
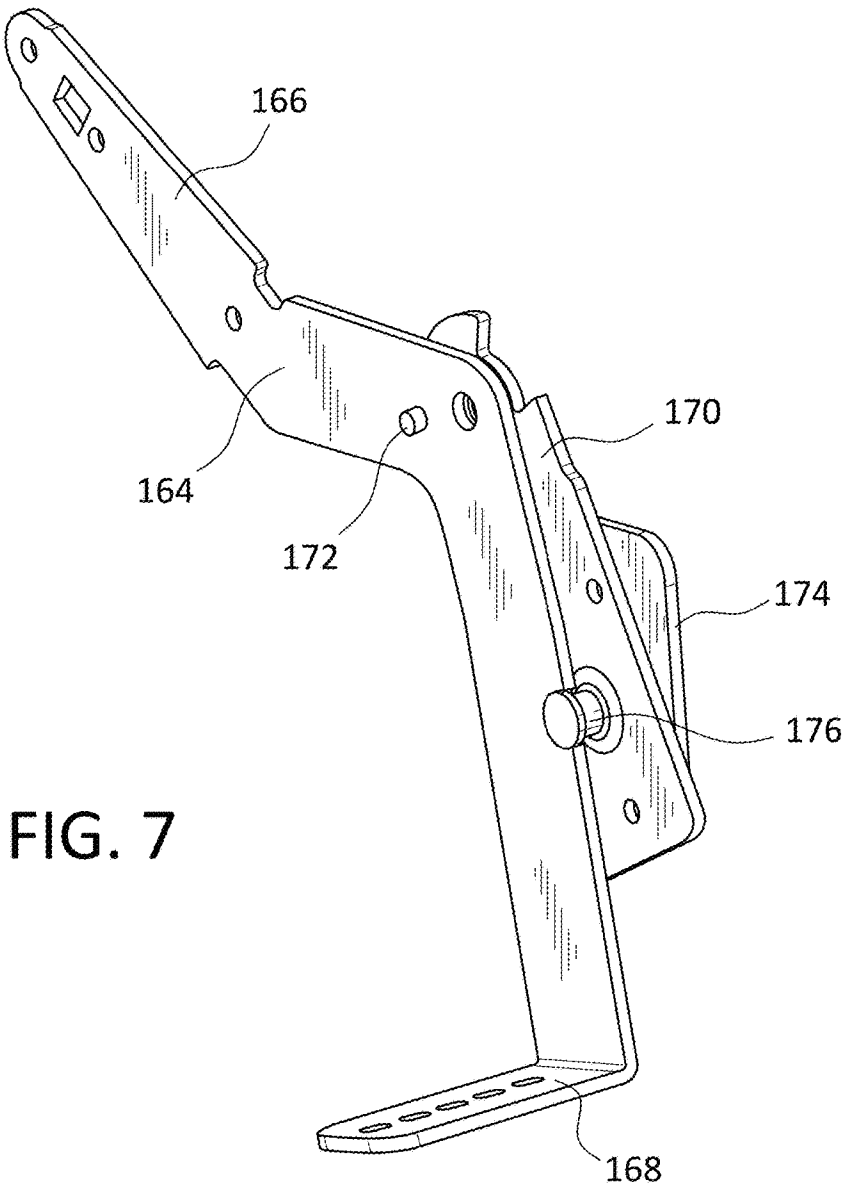
Figure 8:
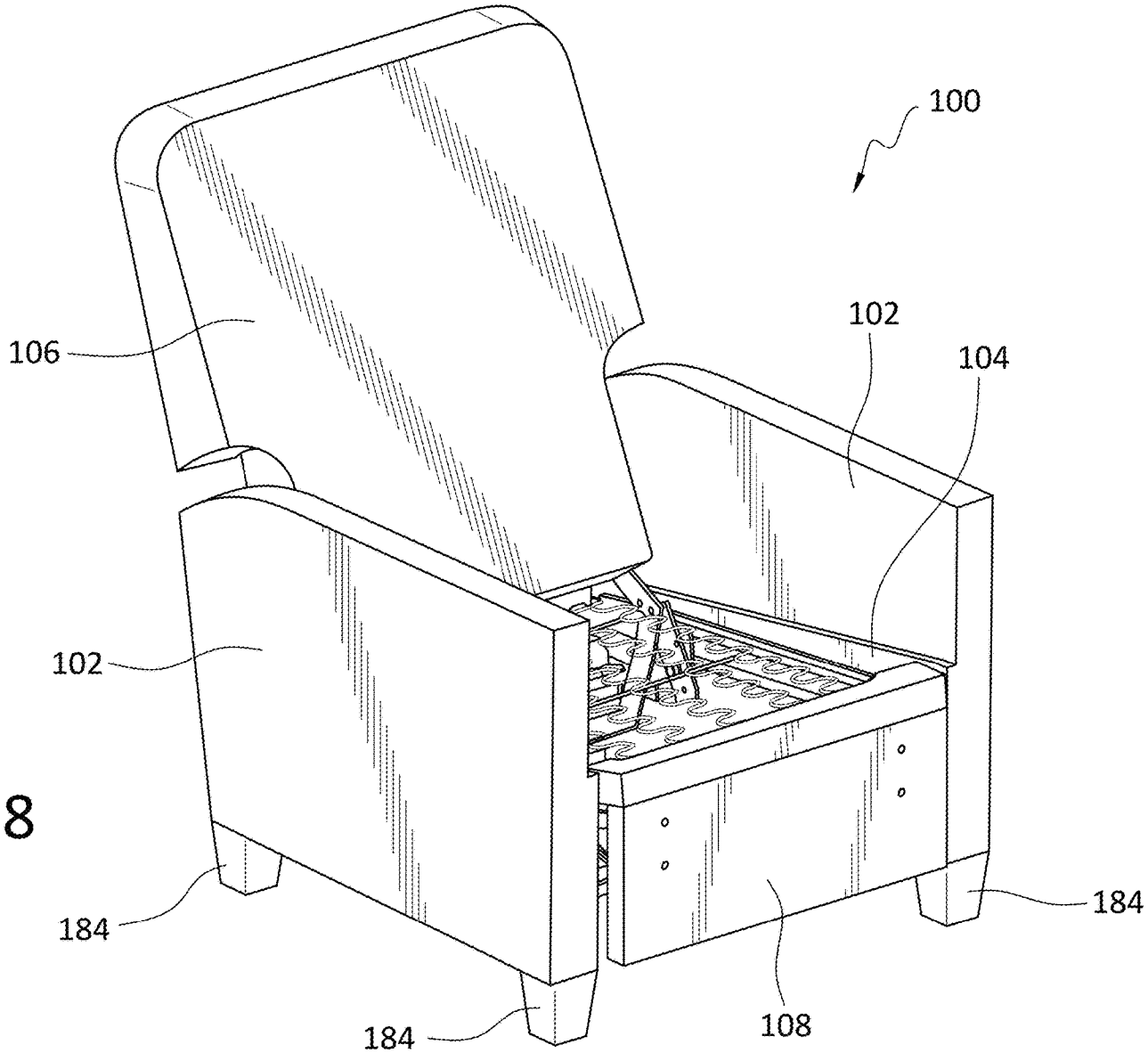

FIG. 7 is an enlarged detailed view of one of the linkage members, as illustrated within FIG. 6, operatively connecting the second linear actuator to the backrest component of the powered chair; and FIG. 8 is a left side, top perspective view of the new and improved powered chair, as constructed in accordance with the principles and teachings of the present invention, and similar to that show in FIG. 1, wherein the footrest and backrest components of the powered chair have been moved to their retracted and upright positions.

DETAILED DESCRIPTION OF THE PREFERRED EMBODIMENT

Referring now to the drawings, and more particularly to FIGS. 1-5 thereof, a new and improved powered chair, as constructed in accordance with the principles and teachings of the present invention, is disclosed and is generally indicated by the reference character 100. More particularly, it is seen that the new and improved powered chair 100 comprises a pair of left and right, oppositely disposed armrests 102,102, a chair seat frame 104 which is adapted to be fixedly secured to the pair of oppositely disposed armrests 102,102, a backrest 106 which is movable between upright and reclined positions, a footrest 108 which is movable between extended and retracted positions, and a first linear actuator 110 which is operatively connected to the footrest 108 so as to move the footrest 108 between its extended and retracted positions. As can best be seen in FIG. 4, the first linear actuator 110 has its motor end 112 pivotally mounted upon a first, transversely extending cross-bar 114 by means of a first clevis-type connector 116, while the oppositely disposed end portions of the first cross-bar 114 are fixedly connected to rear, inner surface portions of the pair of left and right, oppositely disposed armrests 102,102 by means of suitable mounting brackets 118,118 as can best be seen in FIG. 2. In a similar manner, and as can best be seen in FIG. 4, the telescopic rod 120 of the first linear actuator 110 is pivotally connected to a second, transversely extending cross-bar 122 by means of a second clevis-type connector 124. In addition, as can best be appreciated from FIGS. 4 and 5, first end portions of a pair of oppositely disposed first linkage members 126,126 are pivotally mounted upon a pair of oppositely disposed mounting brackets 128,128 by means of suitable pivotal connections 130,130, while the pair of oppositely disposed mounting brackets 128,128 are fixedly mounted upon forward, inner surface portions of the pair of left and right, oppositely disposed armrests 102,102.

Second, opposite end portions of the pair of oppositely disposed first linkage members 126,126 are pivotally connected to a pair of oppositely disposed second linkage members 132,132 by means of suitable pivotal connections 134,134, while second, opposite end portions of the pair of oppositely disposed second linkage members 132,132 are pivotally connected to the footrest 108 by means of suitable pivotal connections schematically illustrated at 136,136. It is also noted that the oppositely disposed end portions of the second cross-bar 122 are fixedly connected to the pair of oppositely disposed first linkage members 126,126 by means of suitable, L-shaped mounting brackets 138,138. Still further, first end portions of a pair of oppositely disposed third linkage members 140,140 are pivotally mounted upon the pair of oppositely disposed mounting brackets 128,128 by means of suitable pivotal connections 142,142, while second, opposite end portions of the pair of oppositely disposed third linkage members 140,140 are pivotally connected to a pair of oppositely disposed fourth linkage members 144,144 by means of suitable pivotal connections 146,146. Second, opposite end portions of the pair of oppositely disposed fourth linkage members 144,144 are pivotally connected to the footrest 108 by means of suitable pivotal connections schematically illustrated at 146, 146, and in this manner, when the first linear actuator 110 is actuated so as to extend or retract the footrest 108, the footrest 108 will be extended or retracted by means of the first, second, third, and fourth linkage members 126,132, 140, and 144, however, since the first linear actuator 110 is operatively connected to the pair of left and right, oppositely disposed armrests 102,102, and not operatively connected to the chair seat frame 104, movements of the footrest 108 will be entirely independent from the chair seat frame 104, or, in other words, whenever the footrest 108 undergoes any extension or retraction movements, the chair seat frame 104 will remain stationary.

Continuing further, and with reference being made to FIGS. 6 and 7 of the drawings, it is seen that the new and improved powered chair 100 of the present invention further includes a second linear actuator 148, wherein the motor end 150 of the second linear actuator 148 is pivotally mounted upon a third, transversely extending cross-bar 152 by means of a suitable third clevis-type connector 154, while the extensible/retractable telescopic rod end 156 of the second linear actuator 148 is pivotally mounted upon a fourth, transversely extending cross-bar 158 by means of a suitable fourth clevis-type connector 160. It is further seen that oppositely disposed end portions of the third, transversely extending cross-bar 152 are fixedly mounted within a pair of oppositely disposed mounting brackets 162,162, and that the pair of oppositely disposed mounting brackets 162,162 are adapted to be fixedly mounted upon central, inner surface portions of the pair of left and right, oppositely disposed armrests 102,102. A pair of oppositely disposed backrest mounting brackets 164,164 are provided such that upper end portions 166,166 of the pair of oppositely disposed backrest mounting brackets 164,164 are adapted to have the backrest 106 fixedly mounted thereon, while lower end portions of the pair of oppositely disposed backrest mounting brackets 164,164 are provided with L-shaped mounting bracket sections 168,168 which are adapted to be fixedly connected to opposite end portions of the fourth, transversely extending cross-bar 158. Still yet further, it is seen that the pair of oppositely disposed backrest mounting brackets 164,164 are pivotally mounted upon a pair of oppositely disposed backrest support brackets 170,170 by means of suitable pivot pin mechanisms 172,172, and that, in turn, the pair of oppositely disposed backrest support brackets 170,170 are fixedly mounted upon a pair of oppositely disposed mounting brackets 174,174 which are fixedly secured to rear, inner surface portions of the powered chair armrests 102,102. It is lastly seen that each one of the pair of oppositely disposed backrest support brackets 170,170 is provided with an inwardly extending stop pin 176. In this manner, when the telescopic rod member 156 of the second linear actuator 148 is extended, the backrest mounting brackets 164,164 are moved forwardly such that the backrest 106 will be disposed at its upright position, as illustrated within FIG. 8, while when the second linear actuator 148 is retracted, the backrest mounting brackets 164,164 are moved rearwardly such that the backrest 106 will be disposed at its reclined position, as illustrated within FIG. 1, the extent to which the backrest 106 is permitted to be reclined being determined as a result of the pair of oppositely disposed backrest mounting brackets 164,164 engaging the stop pins 176. As was the case with the first linear actuator 110 and the footrest 108, when the second linear actuator 148 is actuated so as to extend or retract the backrest 106, the backrest 106 will be extended or retracted by means of the backrest mounting brackets 164,164, however, since the second linear actuator 148 is operatively connected to the pair of left and right, oppositely disposed armrests 102,102, and not operatively connected to the chair seat frame 104, movements of the backrest 106 will be entirely independent from the chair seat frame 104, or, in other words, whenever the backrest 106 undergoes any extension or retraction movements, the chair seat frame 104 will remain stationary.

Figure 2:
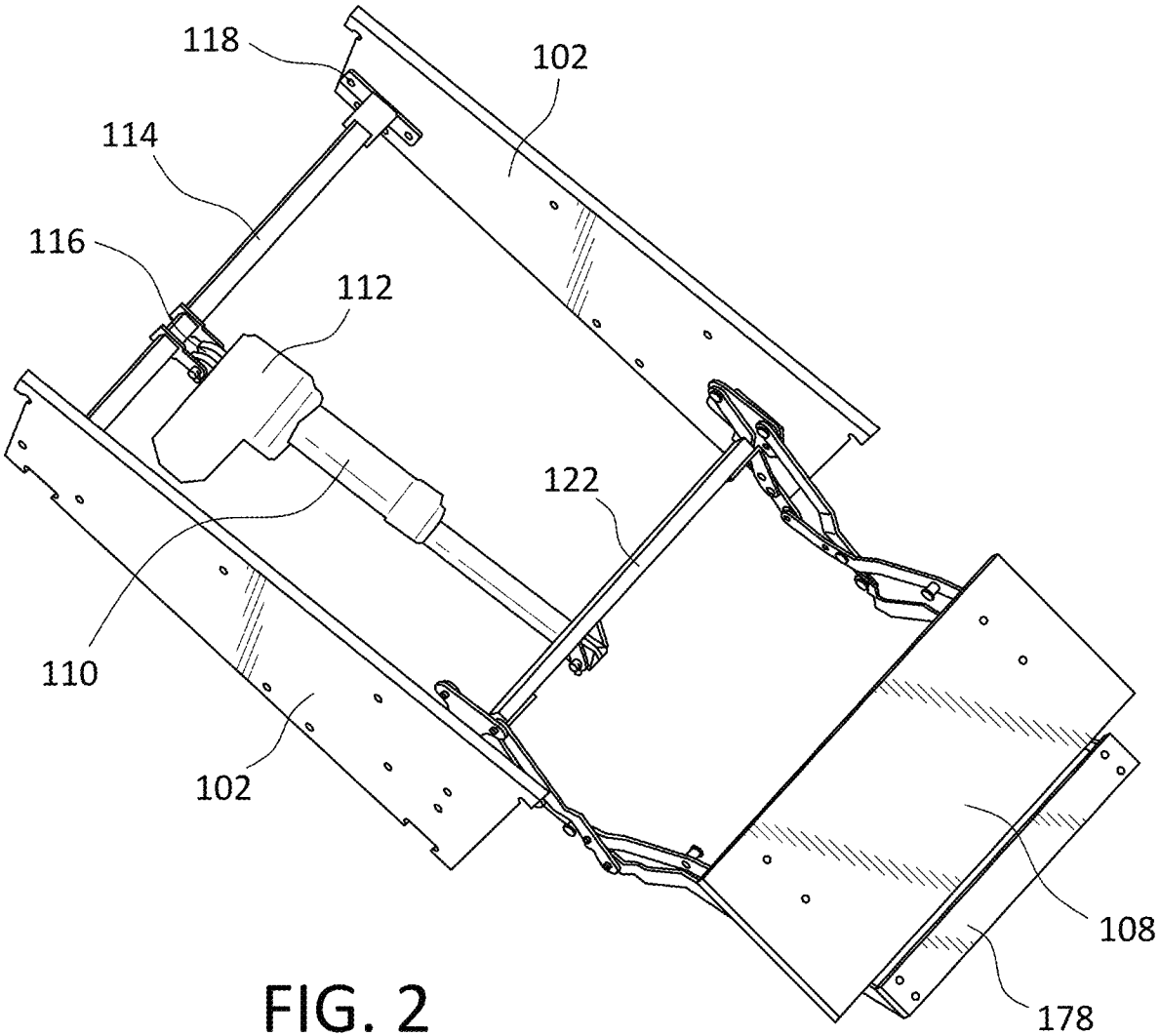
FIG. 2 is a left side, top perspective view of the new and improved powered chair showing the first linear actuator operatively connected to the footrest component of the powered chair and when the first linear actuator has been actuated so as to extend the footrest component from its retracted position to its extended position.
Figure 3:
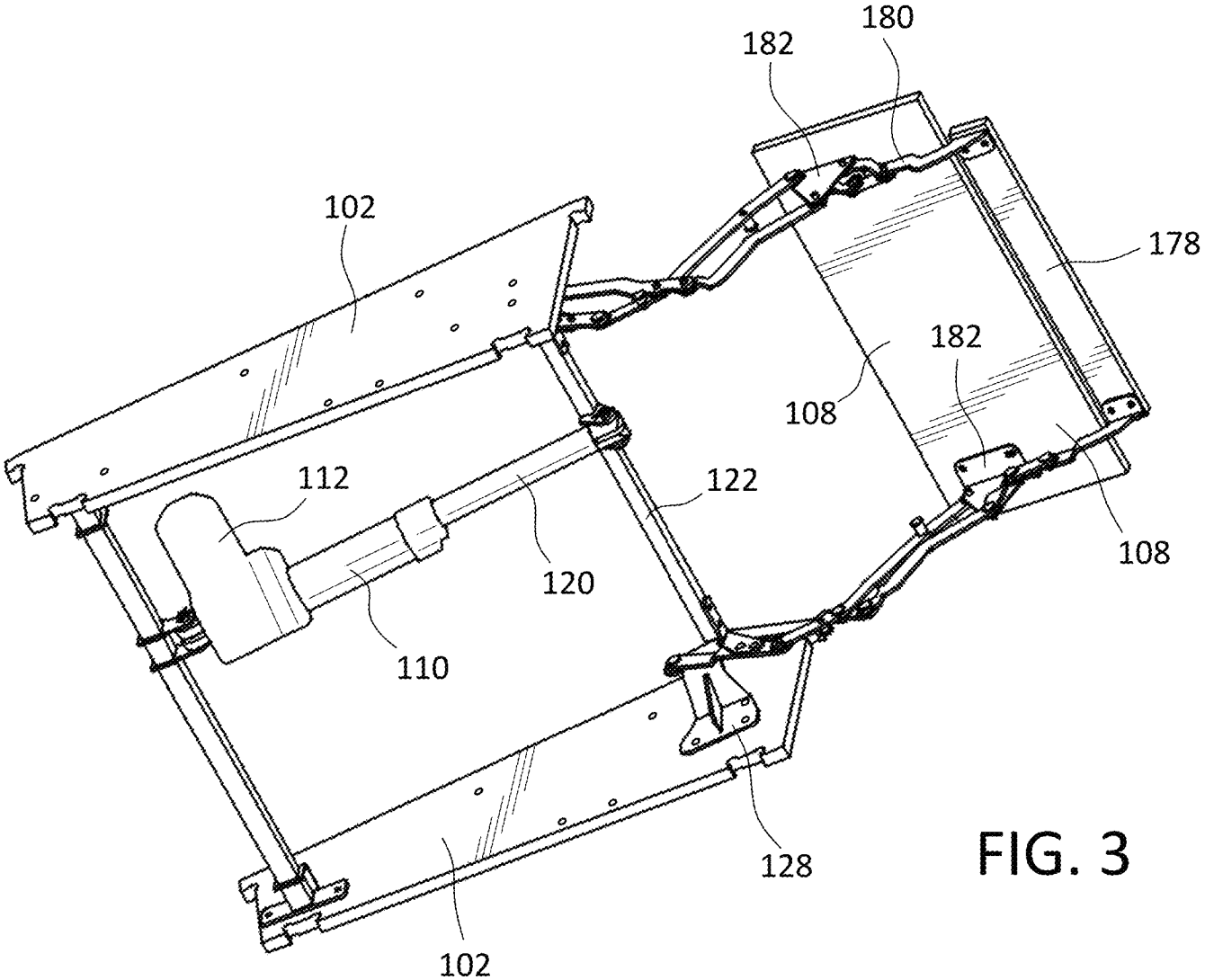
FIG. 3 is a left side, bottom perspective view of the new and improved powered chair showing the first linear actuator operatively connected to the footrest component of the powered chair and when the first linear actuator has been actuated so as to extend the footrest component from its retracted position to its extended position.
Figure 4:
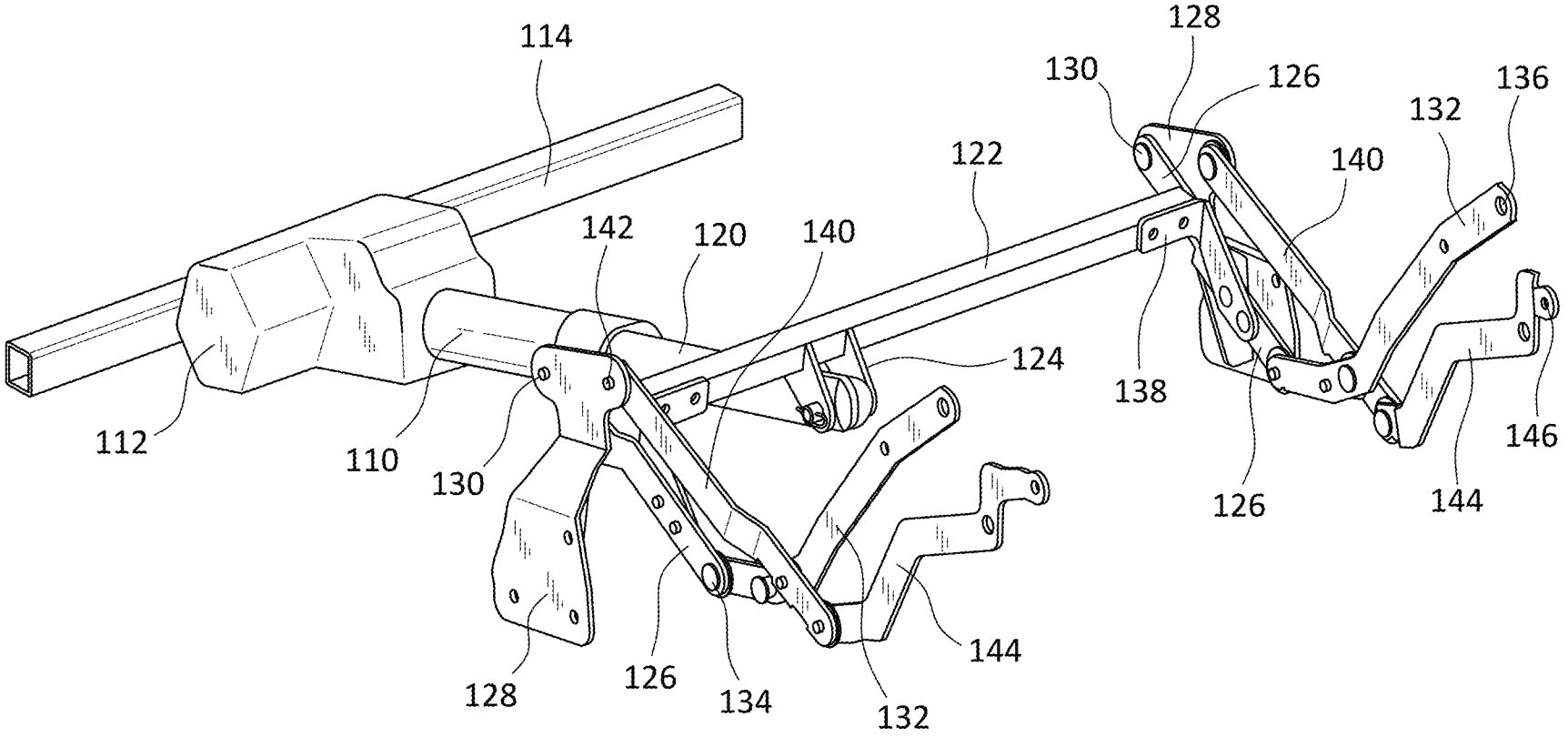
FIG. 4 is a schematic detailed view showing how the first linear actuator is operatively connected to the footrest component of the powered chair by means of a plurality of linkage members.
Figure 5:
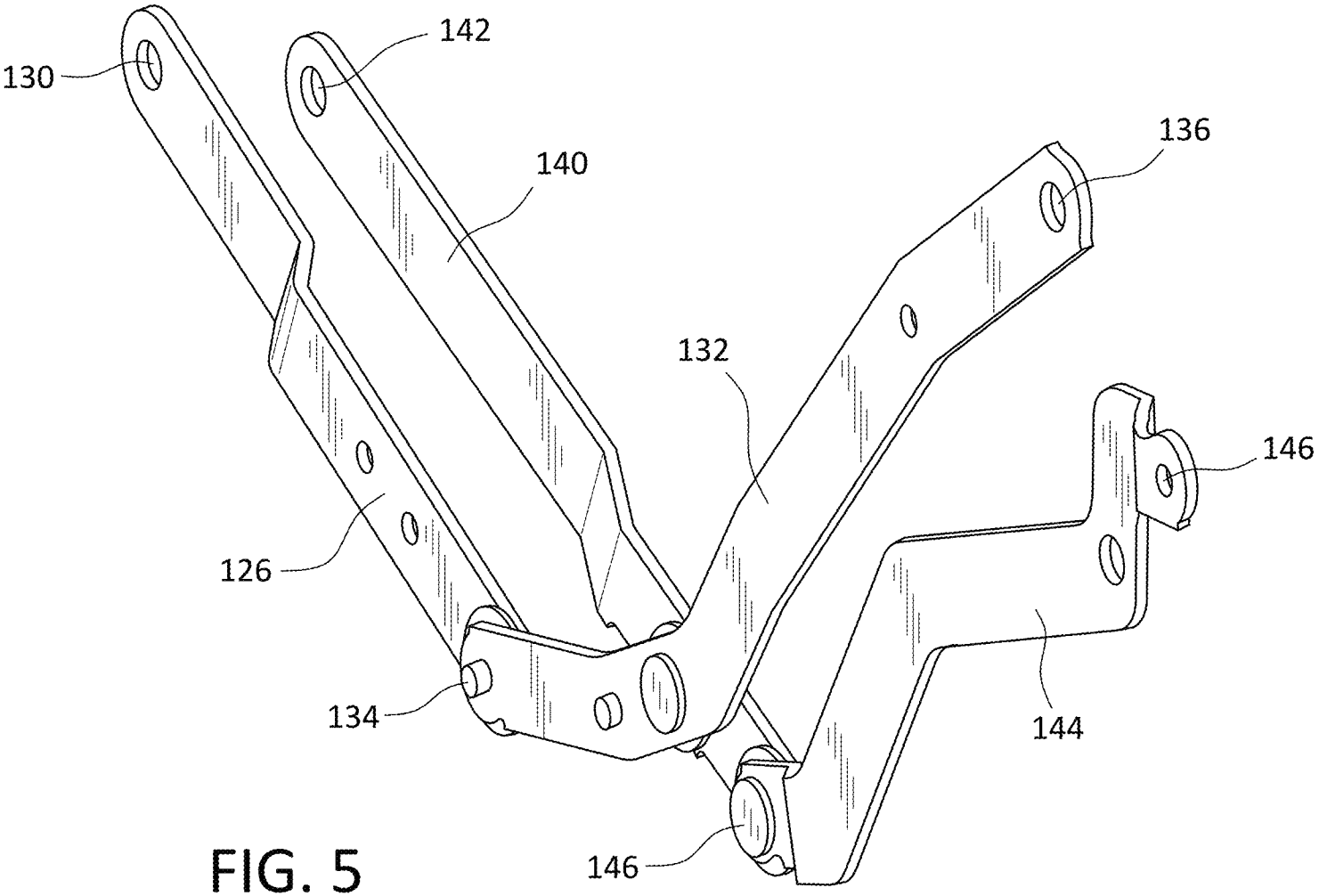
FIG. 5 is an enlarged schematic detailed view showing how the plurality of linkage members operatively connecting the first linear actuator to the footrest component of the powered chair.

Continuing further, and with reference being made to FIGS. 1-3, it is seen that it is further seen that, as a desirable option, an auxiliary or secondary footrest 178 may be provided in conjunction with the main or primary footrest 108 and is operatively connected thereto by means of a pair of oppositely disposed fifth linkage members 180,180 as can best be seen in FIG. 3. As can also be appreciated from FIG. 3, the pivotal connections 136,136,146, 146 of the second and fourth linkage members 132,144 are actually pivotally connected to a pair of oppositely disposed mounting brackets 182,182 which have substantially L-shaped cross-sectional configurations whereby the pair of oppositely disposed mounting brackets 182,182 are fixedly mounted upon undersurface portions of the main or primary footrest 108, the pair of operatively disposed fifth linkage members 180,180 also being operatively connected to the pair of oppositely disposed mounting brackets 182,182. It is to be appreciated that as a result of the provision of the auxiliary or secondary footrest 178 upon the powered chair 100, and when the main or primary footrest 108, together with the auxiliary or secondary footrest 178, are moved to their extended positions, as illustrated within FIGS. 1-3, chair users or occupants, who are relatively tall in stature, can nevertheless have their feet properly and adequately supported when they are seated within the powered chair 100.

With reference lastly being made to FIGS. 1 and 8, it is lastly noted that the new and improved powered chair 100 is provided with a plurality of feet 184, at the four corners of the powered chair 100, wherein the plurality of feet 184 effectively elevate the powered chair 100, with respect to the underlying floor or surface upon which the powered chair 100 is disposed, so as to permit modern cleaning appliances, such as, for example, well-known floor-cleaning robots, not shown, to be capable of moving freely beneath the powered chair 100 so as to clean the floor surface which is disposed beneath the powered chair 100.

Obviously, many variations and modifications of the present invention are possible in light of the above teachings. It is therefore to be understood that within the scope of the appended claims, the present invention may be practiced otherwise than as specifically described herein.

What is claimed as new, and desired to be protected by Letters Patent, is:

1. A powered chair, comprising:

a pair of oppositely disposed armrests;

a chair seat frame fixedly secured to said pair of oppositely disposed armrests;

a backrest pivotally mounted upon said pair of oppositely disposed armrests;

a footrest pivotally mounted upon said pair of oppositely disposed armrests;

a first cross-bar member fixedly mounted upon said pair of oppositely disposed armrests;

a second cross-bar member pivotally mounted upon said pair of oppositely disposed armrests; and a linear actuator operatively connected to said footrest so as to move said footrest between retracted and extended positions and having first and second oppositely disposed ends thereof pivotally mounted upon said first and second cross-bar members;

whereby, since said chair seat frame is fixedly mounted upon said pair of oppositely disposed armrests, said chair seat frame will remain stationary despite movement of said footrest between said retracted and extended positions by said linear actuator.

2. The powered chair as set forth in claim 1, wherein:

said second cross-bar member is operatively connected to said footrest by a plurality of linkage members.

3. The powered chair as set forth in claim 1, wherein:

said footrest comprises a main primary footrest, and an auxiliary secondary footrest operatively connected to said main primary footrest such that when said footrest is moved to said extended position, said main primary footrest and second auxiliary secondary footrest can adequately support the feet of chair users or occupants who are relatively large in stature.

4. The powered chair as set forth in claim 1, wherein:

a plurality of feet elevate said powered chair sufficiently above a support surface upon which said powered chair is disposed so as to permit robotic cleaning appliances to clean the portion of the support surface which is disposed beneath said powered chair.

5. A powered chair, comprising:

a pair of oppositely disposed armrests;

a chair seat frame fixedly secured to said pair of oppositely disposed armrests;

a backrest pivotally mounted upon said pair of oppositely disposed armrests;

a footrest pivotally mounted upon said pair of oppositely disposed armrests;

a first cross-bar member is fixedly mounted upon said pair of oppositely disposed armrests;

a second cross-bar member is pivotally mounted upon said pair of oppositely disposed armrests; and a linear actuator operatively connected to said backrest so as to move said backrest between upright and reclined positions and having first and second oppositely disposed ends thereof pivotally mounted upon said first and second cross-bar members;

whereby, since said chair seat frame is fixedly mounted upon said pair of oppositely disposed armrests, said chair seat frame will remain stationary despite movement of said backrest between said upright and reclined positions by said linear actuator.

6. The powered chair as set forth in claim 5, wherein:

said second cross-bar member is operatively connected to said backrest by a pair of oppositely disposed backrest mounting brackets.

7. The powered chair as set forth in claim 6, wherein:

a pair of oppositely disposed mounting brackets are fixedly mounted upon said pair of oppositely disposed armrests, a pair of oppositely disposed backrest support brackets are fixedly mounted upon said pair of oppositely disposed mounting brackets, and said pair of oppositely disposed backrest mounting brackets are pivotally mounted upon said pair of oppositely disposed backrest support brackets.

8. The powered chair as set forth in claim 7, wherein:

a pair of oppositely disposed stop pins are respectively mounted upon said pair of oppositely disposed backrest support brackets so as to limit the degree to which said backrest can be reclined from said upright position when said linear actuator moves said backrest from said upright position to said reclined position as a result of moving said backrest mounting brackets.

9. The powered chair as set forth in claim 5, wherein:

a plurality of feet elevate said powered chair sufficiently above a support surface upon which said powered chair is disposed so as to permit robotic cleaning appliances to clean the portion of the support surface which is disposed beneath said powered chair.

10. A powered chair, comprising:

a pair of oppositely disposed armrests;

a chair seat frame fixedly secured to said pair of oppositely disposed armrests;

a backrest pivotally mounted upon said pair of oppositely disposed armrests;

a footrest pivotally mounted upon said pair of oppositely disposed armrests;

a first cross-bar member is fixedly mounted upon said pair of oppositely disposed armrests;

a second cross-bar member is pivotally mounted upon said pair of oppositely disposed armrests;

a first linear actuator operatively connected to said footrest so as to move said footrest between retracted and extended positions and having first and second oppositely disposed ends thereof pivotally mounted upon said first and second cross-bar members; and a second linear actuator operatively connected to said backrest so as to move said backrest between upright and reclined positions;

whereby, since said chair seat frame is fixedly mounted upon said pair of oppositely disposed armrests, said chair seat frame will remain stationary despite movement of said footrest between said retracted and extended positions by said first linear actuator, as well as despite movement of said backrest between said upright and reclined positions by said second linear actuator.

11. The powered chair as set forth in claim 10, wherein:

said second cross-bar member is operatively connected to said footrest by a plurality of linkage members.

12. The powered chair as set forth in claim 10, wherein:

said footrest comprises a main primary footrest, and an auxiliary secondary footrest operatively connected to said main primary footrest such that when said footrest is moved to said extended position, said main primary footrest and second auxiliary secondary footrest can adequately support the feet of chair users or occupants who are relatively large in stature.

13. The powered chair as set forth in claim 10, wherein:

a plurality of feet elevate said powered chair sufficiently above a support surface upon which said powered chair is disposed so as to permit robotic cleaning appliances to clean the portion of the support surface which is disposed beneath said powered chair.

14. The powered chair as set forth in claim 10, wherein:

a third cross-bar member is fixedly mounted upon said pair of oppositely disposed armrests;

a fourth cross-bar member is pivotally mounted upon said pair of oppositely disposed armrests; and said second linear actuator has first and second oppositely disposed ends thereof pivotally mounted upon said third and fourth cross-bar members.

15. The powered chair as set forth in claim 14, wherein:

said fourth cross-bar member is operatively connected to said backrest by a pair of oppositely disposed backrest mounting brackets.

16. The powered chair as set forth in claim 15, wherein:

a pair of oppositely disposed mounting brackets are fixedly mounted upon said pair of oppositely disposed armrests, a pair of oppositely disposed backrest support brackets are fixedly mounted upon said pair of oppositely disposed mounting brackets, and said pair of oppositely disposed backrest mounting brackets are pivotally mounted upon said pair of oppositely disposed backrest support brackets.

17. The powered chair as set forth in claim 16, wherein: a pair of oppositely disposed stop pins are respectively mounted upon said pair of oppositely disposed backrest support brackets so as to limit the degree to which said backrest can be reclined from said upright position when said second linear actuator moves said backrest from said upright position to said reclined position as a result of moving said backrest mounting brackets.

* * * * *